US007795200B2

(12) United States Patent
Durrant

(10) Patent No.: US 7,795,200 B2
(45) Date of Patent: Sep. 14, 2010

(54) TEXTILE CLEANING COMPOSITION AND METHOD OF USE

(76) Inventor: Edward E. Durrant, P.O. Box 465, Paradise, UT (US) 84328

( * ) Notice: Subject to any disclaimer, the term of this patent is extended or adjusted under 35 U.S.C. 154(b) by 177 days.

(21) Appl. No.: 11/765,285

(22) Filed: Jun. 19, 2007

(65) Prior Publication Data

US 2008/0153735 A1 Jun. 26, 2008

Related U.S. Application Data

(62) Division of application No. 11/183,119, filed on Jul. 14, 2005, now abandoned.

(51) Int. Cl.
*C11D 7/02* (2006.01)
*C11D 7/26* (2006.01)
*C11D 7/54* (2006.01)

(52) U.S. Cl. ..... 510/303; 510/370; 510/477; 510/488; 510/499; 510/505; 510/280; 8/111; 8/137

(58) Field of Classification Search ..... 510/303, 510/370, 477, 488, 499, 505, 280; 8/111, 8/137
See application file for complete search history.

(56) References Cited

U.S. PATENT DOCUMENTS

| | | | | |
|---|---|---|---|---|
| 3,607,760 | A | | 9/1971 | McIntyre |
| 3,994,744 | A | | 11/1976 | Anderle et al. |
| 4,108,771 | A | | 8/1978 | Weiss |
| 4,124,542 | A | | 11/1978 | Devine |
| 4,203,859 | A | | 5/1980 | Kirn et al. |
| 4,336,165 | A | | 6/1982 | Weisensel |
| 4,490,270 | A | | 12/1984 | Hackett et al. |
| 4,678,595 | A | | 7/1987 | Malik et al. |
| 4,902,434 | A | | 2/1990 | Dickerson |
| 5,336,431 | A | | 8/1994 | Richards et al. |
| 5,395,555 | A | | 3/1995 | Colurciello et al. |
| 5,439,610 | A | * | 8/1995 | Ryan et al. ..... 510/280 |
| 5,741,553 | A | | 4/1998 | Manolas et al. |
| 5,855,625 | A | * | 1/1999 | Maurer et al. ..... 8/137 |
| 5,905,065 | A | | 5/1999 | Scialla et al. |
| 5,928,384 | A | | 7/1999 | Scialla et al. |
| 5,984,993 | A | | 11/1999 | Mainz et al. |
| 6,059,973 | A | | 5/2000 | Hudson |
| 6,326,344 | B1 | | 12/2001 | Levitt |
| 6,506,716 | B1 | * | 1/2003 | Delplancke et al. ..... 510/336 |
| 6,537,536 | B1 | | 3/2003 | Kronberg et al. |
| 6,693,068 | B1 | | 2/2004 | Ryan et al. |
| 6,827,792 | B2 | | 12/2004 | Cervero et al. |
| 2002/0139392 | A1 | | 10/2002 | Cervero et al. |
| 2002/0150779 | A1 | | 10/2002 | Ward et al. |
| 2005/0019207 | A1 | | 1/2005 | Oliver et al. |

* cited by examiner

*Primary Examiner*—Gregory R Del Cotto
(74) *Attorney, Agent, or Firm*—Advantia Law Group; Michael W. Starkweather

(57) ABSTRACT

This invention includes a cleaning composition, the method of use of the cleaning composition, and a new use of a composition. The composition includes an oxidizing agent with a reduction potential of greater than about 0.1 E°(V) at 25° C., and is devoid of an oxidizing agent with a reduction potential of greater than about 1.5 E°(V) at 25° C. The oxidizing agent may be a salt of a nitrate or nitrite. The method includes applying the composition to a textile and working the composition. The composition may be effective in cleaning urine odors from textiles. The composition may remove odors from textiles without bleaching or discoloring the textile, even if the textile includes natural fibers such as wool.

6 Claims, No Drawings

TEXTILE CLEANING COMPOSITION AND METHOD OF USE

CROSS-REFERENCE TO RELATED APPLICATIONS

This application claims priority to the nonprovisional patent application, to which this application is a divisional thereof, titled "TEXTILE CLEANING COMPOSITION & METHOD OF USE," Ser. No. 11/183,119, filed Jul. 14, 2005, now abandoned, which is incorporated by reference herein.

FIELD OF THE INVENTION

The present invention relates to textile cleaning compositions and their method of use, specifically textile cleaning compositions containing oxidizing agents such as salts of nitrates and nitrites.

BACKGROUND OF THE INVENTION

Various textiles such as carpets, rugs, furniture, and upholstery are subject to contamination by staining compounds such as urine. Urines may stain textiles causing odiferous, discoloring, and texture modifying effects. Some of the typical shampooing or cleaning agents available do not completely remove the odor or discoloration, especially when the odor or discoloration is from urine. Other typically available shampooing or cleaning agents cause undesirable results such as discoloration or bleaching of the textile. Discoloration or bleaching often occurs when using a shampoo or cleaning agent that is either too basic or too acidic, or contains an oxidizing agent with a strong reduction potential. Discoloration or bleaching often occurs in textiles containing natural fibers. The discoloration or bleaching may occur because of acidity, alkalinity or strong reduction potentials. However, it has been generally observed that a stronger reduction potential works better to remove stains from textiles, especially odors or discolorations from urine.

DESCRIPTION OF THE RELATED ART

U.S. Pat. No. 5,395,555, issued to Colurciello, et al, discloses an aqueous cleaning composition with a pH of from about 4 to about 9.5 for carpets, rugs and textiles, and for reducing the odor of urine stains. The composition includes a chelating agent (sodium or potassium salt of a diethylenetriaminepentaacetic acid, an ethylenediaminetetraacetic acid (EDTA), a N-hydroxyethylethylenediaminetriacetic acid, or mixtures thereof), diethylenetriaminepentaacetic acid, an EDTA, a N-hydroxyethylethylenediaminetriacetic acid, or a mixture thereof, an anionic surfactant (sodium lauryl sulfate), octylphenoxypolyethoxy ethanol, fragrance, and a preservative 1,2-benzoisothiazole-3(2H)-ones.

U.S. Pat. No. 3,607,760, issued to McIntyre, discloses a composition for removing pet stains from carpets and the like. The composition includes butyl cellosolve (2-butoxy ethanol), isopropyl alcohol (or ethyl alcohol), hydrogen peroxide, EDTA, and water.

It is also known to use an oxidizing agent such as peroxide in a cleaning composition. It has been observed, however, that such oxidizing agents result in a discoloration or bleaching of the textile. It has been further observed that bleaching or discoloration occurs more frequently when using an oxidizing agent with a reduction potential of about equal to or greater than that of a peroxide on natural fibers.

Throughout this specification, the use of the term "Molar" is taken to indicate the number of moles of the compound in one liter of solution, as is known in the art. Likewise, the term "millimolar" is taken to indicate the number of millimoles of the compound in one liter of solution. A millimole is one one-thousandth of one mole.

In light of this art, what is desired is a cleaning composition that solves one or more of the problems disclosed herein, or one or more of the problems that would be apparent from reading this disclosure.

SUMMARY OF THE INVENTION

The present invention has been developed in response to the present state of the art, and in particular, in response to the problems and needs in the art that have not yet been fully solved by currently available cleaning compounds. Accordingly, the present invention has been developed to provide a cleaning composition that may remove stains or odors, and especially odors caused by urine, without bleaching or discoloring the textile.

In one embodiment, the cleaning composition includes an oxidizing agent with a reduction potential of greater than about 0.1 E°(V) at 25° C., and is devoid of an oxidizing agent with a reduction potential of greater than about 1.5 E°(V) at 25° C. The oxidizing agent may be a salt of a nitrate or a nitrite. The oxidizing agent may be sodium nitrate or sodium nitrite. The concentration of oxidizing agent in the cleaning composition could be from about 0.1 moles to about 2 moles per liter of cleaning composition. The cleaning composition may contain a buffering agent with an acid dissociation constant of from about 4 to about 6. The buffering agent may be adipic acid. The concentration of buffering agent in the cleaning composition could be from about 0.02 moles to about 0.30 moles per liter of cleaning composition. The cleaning composition may include an oxidizing agent in the concentration of from about 0.1 to about 4.0 moles of oxidizing agent per liter of composition. The cleaning composition may include a buffering agent in the concentration of from about 0.015 to about 0.30 moles of buffering agent per liter of composition. The cleaning composition may be used to remove the odor resulting from urine on textiles. The textile may include natural fibers.

In another embodiment, the invention is a method for cleaning a urine odor from a textile. The method includes the steps of applying the cleaning composition to the textile and working the cleaning composition into the textile. The composition may include the composition described above.

In yet another embodiment, the invention is a new use for a composition that includes an oxidizing agent and is devoid of an oxidizing agent with a reduction potential of greater than about 1.5 E°(V) at 25° C. The new use includes applying the composition to a textile that has a urine stain, and working the composition. The oxidizing agent may be a salt of a nitrate or a nitrite. The oxidizing agent may be sodium nitrate or sodium nitrite. The textile may include natural fibers. The composition may include a buffering agent with an acid dissociation constant (pKa) of from about 4 to about 6. The oxidizing agent may have a concentration of from about 0.1 to about 2 moles per liter of composition. The buffering agent may have a concentration of from about 0.02 to about 0.3 moles of buffering agent per liter of composition.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

DETAILED DESCRIPTION OF THE INVENTION

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

One embodiment of the present invention is directed to a cleaning composition that includes an oxidizing agent with a reduction potential low enough such that it does not substantially discolor or bleach a textile.

Another embodiment of the present invention is directed to the method of cleaning a urine odor from a textile wherein a composition including an oxidizing agent with a reduction potential low enough such that it does not substantially discolor or bleach a textile is applied to the textile and worked into the textile.

A further embodiment of the present invention is directed toward a new use of the composition that includes an oxidizing agent with a reduction potential low enough such that it does not substantially discolor or bleach a textile, the new use includes the steps of application of the composition to a textile with a urine odor, and working the composition into the textile.

The composition according to any of the embodiments may have a pH such that the acidity or basicity of the composition does not discolor or bleach the textile. An oxidizing agent of the cleaning composition may include an oxidizing agent that retains its oxidizing properties in acidic, neutral and basic environments. The pH may be controlled so as to not discolor or bleach the textile.

An oxidizing agent may have a reduction potential sufficiently low such that the composition does not discolor or bleach the textile. As is known in the art, an oxidizing agent has the potential to be reduced. A reduction potential is a measure of the relative potential of a compound to be reduced. A higher reduction potential indicates that the compound has greater potential to be reduced, and is, therefore, a stronger oxidizing agent.

It has been found that oxidizing agents have an effect on odiferous and/or staining compounds on textiles. For example, the use of an oxidizing agent reduces the odors left by urine. It has been unexpectedly found, however, that certain oxidizing agents that have reduction potentials lower than those that cause discoloration or bleaching of textiles have the beneficial effect of removing odors on textiles. It has been further found that certain oxidizing agents with reduction potentials lower than the reduction potentials of oxidizing agents that cause the textile to discolor or bleach have the beneficial effect of removing odors left by urine.

In one embodiment, the cleaning composition includes an oxidizing agent in the concentration of from about 0.1 Molar, or from about 0.25 Molar; to about 2 Molar, or to about 1 Molar. In another embodiment, the cleaning composition is in a concentrated form and has a concentration of an oxidizing agent of about 4 Molar.

The oxidizing agent has a reduction potential of less than about the reduction potential of a peroxide. The reduction potential of hydrogen peroxide is about 1.78 E°(V) at 25° C. The cleaning composition is substantially devoid of an oxidizing agent with a reduction potential of greater than about the reduction potential of a peroxide, or less than about 1.78 E°(V). In one embodiment, the oxidizing agent has a reduction potential of less than about 1.5 E°(V), or less than about 1.0 E°(V); and greater than about 0.1 E°(V), or greater than about 0.25 E°(V).

An oxidizing agent may include nitrate salts and nitrite salts. Nitrate and nitrite salts have the unexpected benefit of effectively removing urine odors without bleaching or discoloring the textile, even if the textile includes natural fibers. The benefit is unexpected because the reduction potentials of nitrates are lower than the reduction potentials of currently used oxidizing agents such as peroxides.

Nitrate salts may include any nitrate salts known in the art that are oxidizing agents. Nitrate salts may include organic and inorganic nitrate salts. Some non-limiting examples of inorganic nitrate salts include sodium nitrate, potassium nitrate, calcium nitrate, and so forth. The preferred inorganic nitrate salt is sodium nitrate due to the reduction potential being in a range that effectively removes urine odors without bleaching or discoloring the textile, and because it is less expensive than other nitrate salts. The reduction potential of sodium nitrate is about 0.96 E°(V) at 25° C.

Salts of organic nitrates include any that are oxidizing agents. The organic nitrate may include those represented by the following formula:

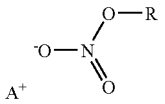

Where $A^+$ may include a cation and R may include hydrocarbyl groups such as, but not limited to, alkyl, cycloalkyl, substituted cycloalkyl, alkenyl, cycloalkenyl, substituted cycloalkenyl, aryl, allyl, substituted aryl, aralkyl, alkaryl, and alkynyl groups. These hydrocarbyl groups may contain heteroatoms such as, but not limited to, nitrogen, oxygen, silicon, sulfur, and phosphorus atoms. R may include other nitrates, resulting in multiple-nitrate compounds. The cation may include any known in the art such as $H^+$, $Li^+$, $Na^+$, $K^+$, $Rb^+$, $Cs^+$ and so forth.

Some non-limiting examples of inorganic nitrite salts include sodium nitrite, potassium nitrite, calcium nitrite, and so forth.

In one embodiment, the cleaning composition also includes a buffering agent. It is believed, but not meant to be limiting, that the buffering agent works to neutralize limited quantities of both acids and bases. This results in the buffering agent keeping the pH of the buffered composition to about the same level even if a limited amount of acid or base is added to the composition. Any buffering agent known in the art could be used to buffer the cleaning composition. As is known in the art, a buffering agent will buffer a composition at a pH about equal to the acid dissociation constant (pKa) of the buffering agent. As is known in the art, the pH of the buffered composition may be increased or decreased by adding a strong base or acid, respectively.

The pH of the cleaning composition may be from about 4 to about 7. A buffering agent with a pKa of from about 4 to about 7 may be used to buffer the cleaning composition of this embodiment. The buffering agent may be an organic acid. Some non-limiting examples of organic acid buffering agents with a pKa of from about 4 to about 7 include: oxalic acid, acetic acid, cacodylic acid, 2-thiazolamine, acrylic acid, malonic acid, melamine, propanoic acid, 3-hydroxypropanoic acid, trimethylamine oxide, 1,2-propanediamine, barbituric acid, alloxanic acid, trans-fumaric acid, maleic acid, 1-methylimidazol, 3-butenoic acid, trans-crotonic acid, methymalonic acid, succinic acid, malic acid, a-tartaric acid, mesotartaric acid, 3-chlorobutanoic acid, 4-chlorobutanoic acid, creatinine, butanoic acid, 2-methylpropanoic acid, 3-hydroxybutanoic acid, 4-hydroxybutanoic acid, 4-aminobutanoic acid, piperazine, pyridine, 2-pyridinamine, itaconic acid, mesaconic acid, 2-oxoglutaric acid, 2,5-pyridinediamine, glutaric acid, methylsuccinic acid, 5-aminolevulinic acid, L-glutamic acid, histamine, 2-methylbutanoic acid, 3-methylbutanoic acid, pentanoic acid, trimethylacetic acid, 5-aminopentanoic acid, 3,6-sinitrophenol, pteridine, 3-pyridinecarboxylic acid, 4-pyridinecarboxylic acid, 4-chloroaniline, 4-fluoroaniline, aniline, 2-methylpyridine, 3-methylpyridine, 4-methylpyridine, methoxypyridine, 4,6-dimethylpyrimidinamine, adipic acid, 3-methylglutaric acid, and adiparnic acid, and so forth. In one embodiment the buffering agent includes adipic acid.

The concentration of the buffering agent in the cleaning composition may be sufficient such that the pH of the cleaning composition does not significantly change when other components of the cleaning composition are added. The concentration should also be sufficient such that when the cleaning composition is used on a textile, the pH of the cleaning composition does not significantly change. For example, if an optional additive that is acidic were added to the cleaning composition without the buffering agent, the pH would decrease. In one embodiment, however, sufficient buffering agent is added to the cleaning composition such that when the additives are included in the cleaning composition, the pH does not change significantly. As another example, if the cleaning composition without a buffering agent is to be used on an acidic stain or odor on a textile, the acidic stain or odor may decrease the pH of the cleaning composition to a point where the cleaning composition either does not work to remove the stain or odor, or discolors or bleaches the textile. However, sufficient buffering agent may be added to the cleaning composition such that even when used on an acidic or a basic stain or odor, the buffering agent resists the change in pH of the cleaning composition such that the composition remains in a pH range where it does work to remove the stain or odor, and does not bleach or discolor the fabric.

The pH of the composition including a buffering agent may be corrected to a desired pH. As is known in the art, the addition of a strong acid (such as hydrochloric acid, sulfuric acid, and so forth) would decrease the pH of the buffered composition, and the addition of a strong base (such as sodium hydroxide, potassium hydroxide, and so forth) would raise the pH of the buffered composition. One skilled in the art would be able to easily calculate the amounts of strong acid or strong base needed to bring the pH of the buffered composition into an acceptable range. Thus, the cleaning composition may include the addition of components meant to correct the pH of the cleaning composition. The components may include strong acids, strong bases, and other components known in the art.

The concentration of buffering agent in the cleaning composition may be from about 0.01, or from about 0.02, to about 0.30, or to about 0.08 Molar. In one embodiment, the concentration of buffering agent in the cleaning composition is about 0.06 Molar.

In one embodiment, the cleaning composition may include a surfactant. It is theorized that the surfactant plays a role in increasing the wetting capabilities of the cleaning composition, but the surfactant may play other roles. The wetting theory of surfactants is not intended to be limiting to the invention. Surfactants commonly exist in three classes, namely ionic (anionic and cationic), nonionic, and zwitterionic. In this embodiment, the surfactant may be ionic, nonionic or zwitterionic. A combination of surfactants may be used, including surfactants from different classes, or surfactants within the same class.

The cleaning composition may also include a preservative. In one embodiment, the preservative includes sodium benzoate. The amount of preservative in the cleaning composition should be sufficient for the properties of the preservative to be manifested in the cleaning composition. In one embodiment the amount of preservative in the cleaning composition is greater than about 0.05 weight percent.

The cleaning composition may include other additives known in the art. Non-limiting examples of the other additives includes solvents, coloring agents, fragrances, activators, inhibitors, thickeners, and so forth.

The composition may be in the form of a concentrate that may be diluted before application to a textile. The production of a concentrated composition has the advantages of requiring a lower mass and a lower volume to ship to the user, thus lowering the cost of the cleaning composition. In one embodiment, the composition is concentrated by decreasing the amount of water added to the cleaning composition. In another embodiment, the cleaning composition is concentrated by increasing the amounts of the non-water components. The concentrate may be formulated such that the concentrate must be diluted from about 10, or from about 13; and to about 20, or to about 17 times before application to a textile. In one embodiment, the concentrate may be formulated such that the concentrate must be diluted about 16 times (that is, one cup of concentrated cleaning composition diluted with one gallon of water) before application to a textile.

The concentrate may include oxidizing agent in the concentration of about 4 Molar in the cleaning composition. The concentrate may include a buffering agent in the concentration of about 1 Molar in the cleaning composition.

The cleaning composition of this invention may be used to clean odors from textiles. The odors my be any known in the art, such as odors caused by foods, drinks, animals, oils, dyes, polishes, and so forth. It has been unexpectedly found that the cleaning composition of the present invention works to substantially remove animal stains, such as odors caused by urine, from textiles. Stains from urine may include, for example, discoloration, odors, texture modification, and so forth.

The textiles that may be cleaned using the cleaning composition of the present invention include any that is known in the art. Some examples of textiles include carpet, rugs, other floor coverings, upholstery, curtains, drapery, clothing, footwear, yarns, and so forth. The textile may be woven or non-woven. The textile may be composed of fibers. The fibers may be natural or synthetic. Some non-limiting examples of synthetic fibers include polypropylene, polyethylene, fiberglass, nylon, rayon, and so forth. Some non-limiting examples of natural fibers include: animal fibers, such as wool, silk, cashmere, mohair, alpaca, camel hair, and so forth; and plant fibers, such as cotton, linen, sisal, abaca, kapok, flax, jute, ramie, hemp, kenaf and so forth.

In another embodiment, the current invention includes a method for cleaning a textile. The type of textile to be cleaned is not meant to be a limiting element of this invention. It is within the scope of this invention that any substrate exposed to a foreign substance that leaves a malodorous, discoloring or texture-modifying effect may be cleaned using the cleaning composition of this invention. Non-limiting examples of textiles to be cleaned include carpets, rugs, furniture, bedding, blankets, clothing, and so forth. One example of a foreign substance includes animal urine.

The method for cleaning the textile includes application of the cleaning composition to the textile. Some non-limiting examples of application of the cleaning composition to the textile include pouring, spritzing, spraying, dabbing, and so forth. The application of the cleaning composition to the textile may be performed using a mechanical applicator such as, for example, a carpet steamer, a carpet shampooer, an aerosol canister, an aerosol canister attached to a floor cleaning apparatus, and so forth. One skilled in the art would recognize the amount of cleaning composition that is necessary. The amount of cleaning composition needed may be affected by, for example, the size of the area to be cleaned, the age of the stain, the intensity of the stain, and so forth. In one embodiment, the entire area of the stain is at least dampened with the cleaning composition.

The composition may then be worked into the textile. Any method of working a cleaning composition in a textile may be employed. Non-limiting examples of working include rubbing, massaging, scrubbing, and so forth. The working may be performed using an apparatus such as, for example, a mop, a floor cleaning apparatus, a carpet steamer, a carpet shampooer, a vacuum cleaner and so forth. Any apparatus useful for working a cleaning composition into a textile may be used.

At any point during the method for cleaning the textile, additional cleaning composition may be applied to the textile. One skilled in the art would recognize when more composition is needed, and how much additional composition to add to the textile. In one embodiment, additional composition may be added to the textile during the working of the cleaning composition into the textile.

Similarly, at any point during the method for cleaning the textile, surplus cleaning composition may be removed from the textile. One skilled in the art would recognize if excess cleaning composition were present during the cleaning of the textile. Further, as the cleaning composition becomes more saturated with foreign substances that may be present on or in the textile, at least a portion of the cleaning composition may be removed. If the removal of cleaning composition resulted in an insufficient amount of cleaning composition present, more cleaning composition may be added as above.

The steps of applying cleaning composition to the textile, working the cleaning composition into the textile, adding additional cleaning composition and removing surplus cleaning composition may be repeated as necessary. On skilled in the art would recognize when steps need to be repeated.

The cleaning composition may be removed. Removal may occur after the textile has been substantially cleaned, or as above, at any point during the cleaning of the carpet. Removal of the cleaning composition may be by any technique known to one skilled in the art. Some non-limiting examples of removal techniques include absorbing, aspirating, passive evaporation, and so forth. Removal of the cleaning composition may be performed using an apparatus such as a floor cleaning apparatus, a carpet shampooer, a carpet steamer, a vacuum cleaner, and so forth.

Yet another embodiment includes a new use of a composition containing an oxidizing agent but devoid of an oxidizing agent having a reduction potential of greater than the reduction potential of a peroxide at 25° C. The composition may include the composition as disclosed above. The new use of the composition includes the method of using the cleaning composition as described above.

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

For example, although the specification includes a list of oxidizing agents, it is envisioned that any oxidizing agent with a reduction potential within the limits described in the specification is within the scope of this invention. As for the buffering agent, any buffering agent with a pKa within the ranges specified is within the scope of this invention, though the specification delineates a list of buffering agents.

The method for cleaning a textile may include any steps use of articles known in the art. For example, additional steps of drying the textile, placing the textile into a drying machine such as a clothes dryer, placing the textile in a cleaning apparatus such as a washing machine, applying additional compositions to the textile, and so forth may be performed within the scope of this invention. Further, use of additional articles such as a washing machine, drying machines, washboards, carpet cleaning apparatuses, abrasive items, spray bottles, spray canisters, pressurized spray bottles, pump-action spray bottles, and so forth may be used at any point in the method within the scope of this invention.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

In order to demonstrate the practice of the present invention, the following examples have been prepared. The examples should not, however, be viewed as limiting the scope of the invention. The claims will serve to define the invention.

EXAMPLES

Nine solutions were prepared and tested. Solution 1 included water only. Solution 2 included an aqueous solution of 5 volume percent of a quaternary ammonium salt. Solution 3 included an aqueous solution of 10 volume parts water to one volume part of a bacterial/enzyme-based odor remover such as that sold under the tradename PRObac HC-400 (available from DASK Corp. of Dallas, Tex.). Solution 4 included an aqueous solution of 1 volume percent of a film-forming chemical designed to encapsulate odors such as that sold under the tradename AlcoGuard® 2425 (available from Alco Chemical of Chattanooga, Tenn.). Solution 5 included a pet urine treatment such as sold under the tradename P.U.R.T.® II (available from Chem-Dry of Logan, Utah). Solution 6 included an aqueous solution 0.25 Molar in potassium nitrate. Solution 7 included an aqueous solution 0.25 Molar in sodium nitrite. Solution 8 included an aqueous solution 0.25 Molar in sodium nitrate and 1 volume percent of Tropical Mist fragrance (available from Chem-Dry of Logan, Utah). Solution 9 included an aqueous solution 0.25 Molar in sodium nitrate and 0.06 Molar in adipic acid buffer. Solution 9 had a pH of 5.5. Table 1 illustrates the solutions, their compositions and relative amounts of each component.

A nylon carpet was treated in several areas with 0.5 mL of cat urine. The carpet was allowed to dry overnight. Each urine spot was then treated with 1 mL of a solution chosen from solutions 1-9 above. The treated areas were then covered with plastic to restrict the evaporation of the applied solutions. After about 24 hours, the plastic was removed and the areas were allowed to completely dry. After the areas had dried, an evaluation of the effectiveness of the different solutions was made by smelling each treated area. The results of the evaluations are illustrated in Table 1.

TABLE 1

| Solution | Component | Amount | Result of Evaluation |
|---|---|---|---|
| 1 | Water | 100 percent | Strong Urine Odor |
| 2 | a Quaternary Ammonium Salt | 5 volume percent | Strong Urine Odor |
| | Water | 95 volume percent | |
| 3 | PRObac HC-400 | 1 volume part | Strong Urine Odor |
| | Water | 10 volume parts | |
| 4 | ALCOGuard ® | 1 volume percent | Strong Urine Odor |
| | Water | 99 volume percent | |
| 5 | P.U.R.T. ® II | 100 percent | No Odor |
| 6 | Potassium Nitrate | 0.25 Molar in Aqueous Solution | Very Slight Urine Odor |
| 7 | Sodium Nitrite | 0.25 Molar in Aqueous Solution | Slight Urine Odor |
| 8 | Sodium Nitrate | 0.25 Molar in Aqueous Solution | Tropical Mist and Very Slight Urine Odor |
| | Tropical Mist Fragrance | 1 volume percent | |
| 9 | Sodium Nitrate | 0.25 Molar in Aqueous Solution | Very Slight Urine Odor |
| | Adipic Acid | 0.06 Molar in Aqueous Solution | |

Solutions 5, 6, 7, and 8 were then tested for bleaching ability on wool and wool-blend carpet swatches. Three carpet types were used. Carpet 1 was 100% wool. Carpet 2 was 80% wool 20% nylon. Carpet 3 was 80% wool 20% polypropylene. 1 mL of solutions 5, 6, 7, 8, and 9 were each applied to the three carpet samples described above. The areas were then covered with plastic to restrict the evaporation of the applied solutions. The samples were then allowed to dwell for about 24 hours and then uncovered and allowed to dry. After the areas were dry, an evaluation was made regarding whether or not the areas had a noticeable color loss (bleaching). The results of these tests are displayed in Table 2.

TABLE 2

| Solution | Carpet 1 100% Wool | Carpet 2 80% Wool 20% Nylon | Carpet 3 80% Wool 20% Polypropylene |
|---|---|---|---|
| 5 | Color Loss | Color Loss | Color Loss |
| 6 | No Color Loss | No Color Loss | No Color Loss |
| 7 | No Color Loss | No Color Loss | No Color Loss |
| 8 | No Color Loss | No Color Loss | No Color Loss |
| 9 | No Color Loss | No Color Loss | No Color Loss |

What is claimed is:

1. A method for cleaning a urine odor from a textile, consisting of:

applying a cleaning composition to the textile, wherein the cleaning composition consists of:

an oxidizing agent in aqueous solution with a reduction potential of greater than about 0.1 E°(V) at 25° C.;

a buffering agent; and devoid of an oxidizing agent with a reduction potential of greater than about 1.5 E°(V) at 25° C.; and working the cleaning composition into the textile.

2. The method of cleaning a urine odor from a textile of claim 1, wherein the oxidizing agent has of a reduction potential of less than about 1.0 E°(V) at 25° C.

3. The method of cleaning a urine odor from a textile of claim 2, wherein the oxidizing agent consists of one selected from the group consisting of: a salt of a nitrate and a salt of a nitrite.

4. The method of cleaning a urine odor from a textile of claim 3, wherein the oxidizing agent consists of one selected from the group consisting of sodium nitrate and sodium nitrite.

5. The method of cleaning a urine odor from a textile of claim 1, wherein the buffering agent has an acid dissociation constant of from about 4 to about 6.

6. The method of cleaning a urine odor from a textile of claim 1, wherein the oxidizing agent consists of a concentration of from about 0.1 to about 2 moles of oxidizing agent per liter of cleaning composition.

* * * * *